United States Patent [19]

Braithwaite et al.

[11] 4,422,788

[45] Dec. 27, 1983

[54] APPARATUS FOR FEEDING A LIQUID TO AN APPLICATOR

[75] Inventors: John D. Braithwaite, Maidenhead; Derrick O. King, Old Windsor; Sidney J. Williams, Virginia Water, all of England

[73] Assignee: Black & Decker Inc., Newark, Del.

[21] Appl. No.: 358,821

[22] Filed: Mar. 16, 1982

Related U.S. Application Data

[63] Continuation of Ser. No. 194,452, filed as PCT GB 79/00131, Aug. 3, 1979, published as WO 80/00 315, Mar. 6, 1980, § 102(e) date Apr. 9, 1980.

[30] Foreign Application Priority Data

Aug. 9, 1978 [GB] United Kingdom ..... 32726/78

[51] Int. Cl.[3] ..... A43K 5/02

[52] U.S. Cl. ..... 401/188 R; 401/190; 401/203; 222/1

[58] Field of Search ..... 401/188, 190, 191, 203-207; 222/1, 325

[56] References Cited

U.S. PATENT DOCUMENTS

| | | |
|---|---|---|
| 2,753,080 | 7/1956 | Bartlett . |
| 3,006,515 | 10/1951 | Midnight . |
| 3,021,976 | 2/1962 | Tracy . |
| 3,572,540 | 3/1971 | LaCroce . |

*Primary Examiner*—Edward M. Coven

*Attorney, Agent, or Firm*—Edward D. Murphy; Harold Weinstein

[57] ABSTRACT

A portable apparatus for feeding liquid under pressure to an applicator, comprises a vessel having a pressurizing assembly associated therewith, the assembly having a housing for receiving a capsule of pressurized gas and having pressure reducing means. A first fluid path extends from the high pressure side of the pressure reducing means and communicates with the outlet of the capsule inserted, in use, in the housing. The vessel has defined therein a first chamber and a second chamber, the second chamber containing, in use, the liquid to be fed to the applicator. A diaphragm is disposed between the first and second chambers. A second fluid path extends from the low pressure side of the pressure reducing means and communicates with the second chamber. Gas is allowed to flow through the diaphragm between the first and second chambers to equalize the pressure in said chambers; but flow of liquid is inhibited from the second chamber to the first chamber whereby the liquid is inhibited from reaching other parts of the apparatus. Preferably this is accomplished by having a small hole or a slit in the diaphragm. A feed conduit is connected to the vessel and communicates with the second chamber for transferring liquid from the second chamber to the applicator. The second chamber may be defined by a liquid container received within the vessel.

36 Claims, 10 Drawing Figures

APPARATUS FOR FEEDING A LIQUID TO AN APPLICATOR

This application is a continuation of application Ser. No. 194,452 filed as PCT GB79/00131, Aug. 3, 1979, published as W080/00 315, Mar. 6, 1980, § 102(e) date Apr. 9, 1980.

FIELD OF THE INVENTION

This invention relates to apparatus for feeding a liquid to an applicator, and in particular, to apparatus primarily intended for painting.

BACKGROUND OF THE INVENTION

For many years it has been common practice to apply a liquid to a surface using a brush, the brush first being dipped in a reservoir of the liquid and then wiped over the surface to be coated. For relatively large surface areas, rollers rather than brushes are used, the roller also being dipped in a reservoir of the liquid and then rolled across the surface to be coated. As an alternative to the use of a brush or roller, a pad has, in more recent times, sometimes been used: again, the pad is dipped in a reservoir of the liquid and then wiped across the surface to be coated.

The mode of application described above is unduly time consuming because of the necessity to dip the applicator (brush, roller or pad), in the liquid at frequent intervals in order to replenish the supply of liquid on the applicator. This is a particular problem when the user is standing on a ladder or a pair of steps which is frequently the case, for example when painting a ceiling. To mitigate this problem it has been proposed in the case of rollers to increase the liquid capacity of the roller by providing it with its own small liquid reservoir; this attempted solution, however, considerably increases the weight of the roller making it very tiring to use.

From time to time throughout this century it has been proposed to provide the liquid applicator with a connection via a length of tube to a reservoir of liquid and to feed the liquid from the reservoir to the applicator by pressure generated by a pump. This arrangement has the considerable advantage over the conventional arrangements described above that a user does not continually have to resplenish the liquid on the applicator nor does the applicator have to be excessively heavy. These proposed pressurised arrangements have not, however, proved satisfactory. If the reservoir of liquid and its associated pump is placed on the ground during application of the liquid then a long length of tubing is required between the reservoir and the applicator and this can impede the user. If, on the other hand, the reservoir and pump are carried by the use then this impedes the user during painting and is tiring as a result of the weight of the reservoir and pump assembly.

It is known to disperse a liquid from a container using a small capsule of pressurized gas. For example, soda syphons have been available for some years operating on this principle. National Can Corporation have disclosed a paint apparatus in which a container of paint is pressure fed by pressurized gas from a capsule to a roller; in operation the container is rested on the ground and a long length of tubing connected between the container and the roller to allow a user to paint a surface, holding the roller alone. An illustration of this proposed apparatus appeared on pages 30A and 31A of the Journal of Paint Technology Vol. 40, No. 521, June 1968. Liquid containers pressurized by capsules of gas are also described in U.S. Pat. Nos. 3,352,457 and 3,558,010 assigned to National Can Corporation.

The painting apparatus proposed by the aforesaid patents ('457 and '010) still suffers various drawbacks. The use of a long length of tubing can impede the user as already mentioned and also this apparatus, as well as the pressurized arrangements already described, is difficult to clean and messy to use. If the painting apparatus includes its own pressure vessel for containing the paint, the paint must first be poured into this vessel and then, after painting, any paint left in the vessel must be poured out and the vessel, in addition to all the rest of the apparatus, must be cleaned. The time saved during painting with the apparatus may thus be consumed in extra time spent preparing the apparatus for use and cleaning the apparatus after use.

To some extent, the cleaning operation can be reduced by supplying the paint in its own pressure vessel to which the pressurizing arrangement is then directly attached, since this avoids the need to clean the vessel after use. However, in this case the vessel containing the paint must be specially constructed both to withstand the pressure contained in the vessel during use and to receive the pressurizing arrangement. This greatly increases the cost of the paint vessel over a conventional paint can.

SUMMARY OF THE INVENTION

It is an object of the invention to provide an apparatus for feeding a liquid to an applicator, that mitigates at least some of the disadvantages described above.

Accordingly, there is provided by one aspect of the invention a portable apparatus for feeding paint, or other liquid, under pressure to an applicator and comprising a disposable container received, in use, within the interior of an outer vessel with part of the interior of the outer vessel remaining for occupancy by gas. A pressurizing assembly is supported by the vessel, and includes a housing having a capsule of pressurized gas and further having pressure reducing means therein, the pressure reducing means having a high pressure side and a low pressure side, the low pressure side communicating with the interior of the container to pressurize the latter. A feed conduit is connected, in use, to the applicator and extends into the outer vessel and into the interior of the container for transferring liquid therefrom to the applicator. The container has a lid fitted thereto and extending over the top thereof. The lid has a hole therein, and the feed conduit extends through this hole and is removable and insertable therethrough as a close fit therein. Restricted transfer means, associated with the container, allows flow of gas between the interior of the vessel and the interior of the container to equalise the pressures therein, but prevents passage of paint, except at a very slow rate, therethrough from the container into the interior of the outer vessel. The combination of the paint container having a lid, the feed conduit having a close fit with respect to the hole in the lid, and the functioning of the restricted transfer means substantially prevents liquid from contaminating the interior of the outer vessel, even if during use this vessel is inadvertently knocked over.

The use of a small capsule of liquified or pressurized gas to provide the pressure in the container provides an extremely compact, lightweight and convenient pressurizing arrangement.

The provision of a container within the vessel is an important feature of the present invention. The liquid to be fed to an applicator can be sold in the container which, since it is, in use, disposed in the outer vessel does not have to be a pressure vessel and can be of simple construction. After the liquid has been fed from the container, the latter can be thrown away and the vessel does not have to be cleaned.

The feed conduit may pass through the top of the vessel in the top of the container to a location adjacent the bottom of the container. The feed conduit may pass through the container in such a way that the junction between the container wall and the feed conduit is closed over. This inhibits liquid spilling from the container into the vessel. A small hole may be provided in the top of the container to allow gas to flow between the container and the vessel to equalize the pressure therein. Alternatively a slit may be provided in the top of the container.

The container may also include a closure member which can be secured over the top of the container when the container is not in use to seal the container. This preserves the liquid in the container when it is not in use and prevents spillage.

The pressure reducing means may be adjustable to vary the pressure, in use, in the vessel. The range of pressure variation may be limited.

The pressure reducing means may include a valve member mounted in a passage providing communication between the first fluid path and the second fluid path, the valve member being movable between a first position in which the passage is closed and a second position in which the passage is open, the valve member being resiliently biased, in use, into the first position, and a piston or diaphragm co-operable with the valve member and movable away from one position in which the valve member is held in the second position by the piston or diaphragm to another position in which the valve member assumes its first position, the piston or diaphragm being biased to said one position by a spring and being biased away from said one position to another position by the pressure of gas on the low pressure side of the pressure reducing means.

The bias force of the spring acting on the piston or diaphragm may be adjustable, whereby the pressure of gas required to move the piston or diaphragm away from said one position to another position is adjustable.

In use, a capsule of liquified or pressurized gas is located in the housing. The gas may be carbon dioxide or nitrous oxide or any gas which does not have too substantial a deleterious effect on the liquids with which it will come into contact.

The vessel may comprise a body part and a lid.

The lid may be mounted on the body part of the vessel such that if excess pressure develops between the lid and the body part the vessel is vented between the lid and the body part.

A pipe may be provided through the lid to provide the feed conduit for transferring liquid from the vessel to an applicator.

The pressurizing assembly may be mounted on the lid.

The vessel may be arranged to be carried by a user without using his hands. In this case the user has both hands free to operate the applicator or perform any other function.

A handle may be mounted on the vessel. The handle may be of inverted rectangular 'U' shape.

A clip may be provided on the vessel for attaching the vessel to a belt, to enable a user to suspend the vessel from his waist.

A pressure relief valve may be mounted in a wall of the vessel. The pressure relief valve may be mounted on the lid of the vessel. An actuating arrangement may be provided for actuating the pressure relief valve each time the apparatus is assembled for use. Such an arrangement safeguards against the possibility of the pressure relief valve becoming stuck.

Manually operable means may be provided for venting the pressurized gas in the vessel to return the pressure in the vessel to atmospheric pressure. The venting means may be provided by the pressure reducing means. Alternatively the venting means may be provided by some other arrangement, for example by the pressure relief valve.

In use, an applicator is connected to the feed conduit via a length of flexible tube. The applicator may, for example, be a pad, a roller or a brush. The length of tube is preferably between one and two meters long. The tube must be long enough to allow a user full range of movement of the applicator but excessive length is undesirable as it may impede the user, increases the pressure required to feed the liquid and adds to the length of tube to be cleaned. In a particular example of the invention the tube is one and a quarter meters long. The applicator is preferably provided with a valve for controlling the flow of liquid along the tube.

According to another aspect of the invention, in place of the disposable container, a partition may extend across the interior of the outer vessel near its top and define a liquid containing portion of the vessel beneath the partition. Preferably the vessel has a lid removably attached to a body part.

The partition inhibits liquid reaching other parts of the apparatus but allows gas to flow into the liquid containing portion of the vessel. The partition may include a small hole or slit to provide a gas flow path.

The partition may be interposed between the lid and the body of the vessel and provide a seal between the lid and the body. The arrangement may be such that unless the partition is fitted, the lid does not seal on the body. This prevents the apparatus being used without the partition.

A filter may be provided adjacent the end of the feed conduit in the vessel to filter liquid passing into the end of the feed conduit.

The feed conduit may pass out of the vessel through the partition and the lid of the vessel. Alternatively the feed conduit may pass out of the vessel at its bottom end.

In the case where the conduit passes out through the lid of the vessel, a plurality of balls may be provided in a chamber defined by the filter around the end of the feed conduit, the balls having a lower density than the liquid contained, in use, in the vessel and being of a diameter larger than the internal diameter of the bottom end of the feed conduit, the arrangement being such that when, in use, the level of liquid in the vessel approaches the bottom end of the conduit, one of the balls assumes a position overlying the bottom end of the conduit and closes the conduit.

In the case where the conduit passes out of the vessel at its bottom end a float valve member may be provided above the end of the feed conduit and may be arranged for movement between a lower position in which the float valve member covers the end of the feed conduit and an upper position in which the float valve member is spaced from the end of the feed conduit, the arrangement being such that when, in use, the level of liquid in the vessel approaches the entrance to the conduit, the float valve member moves from its upper position to its lower position.

The float valve member and filter may form part of a single assembly. The assembly may be removably seated on the bottom wall of the vessel.

A rod may be attached to the assembly extending upwards to the top of the vessel.

BRIEF DESCRIPTION OF THE DRAWINGS

By way of example, an apparatus for feeding a liquid to an applicator will now be described with reference to the accompanying drawings, in which.

DETAILED DESCRIPTION OF THE PREFERRED EMBODIMENTS

Figure 1:
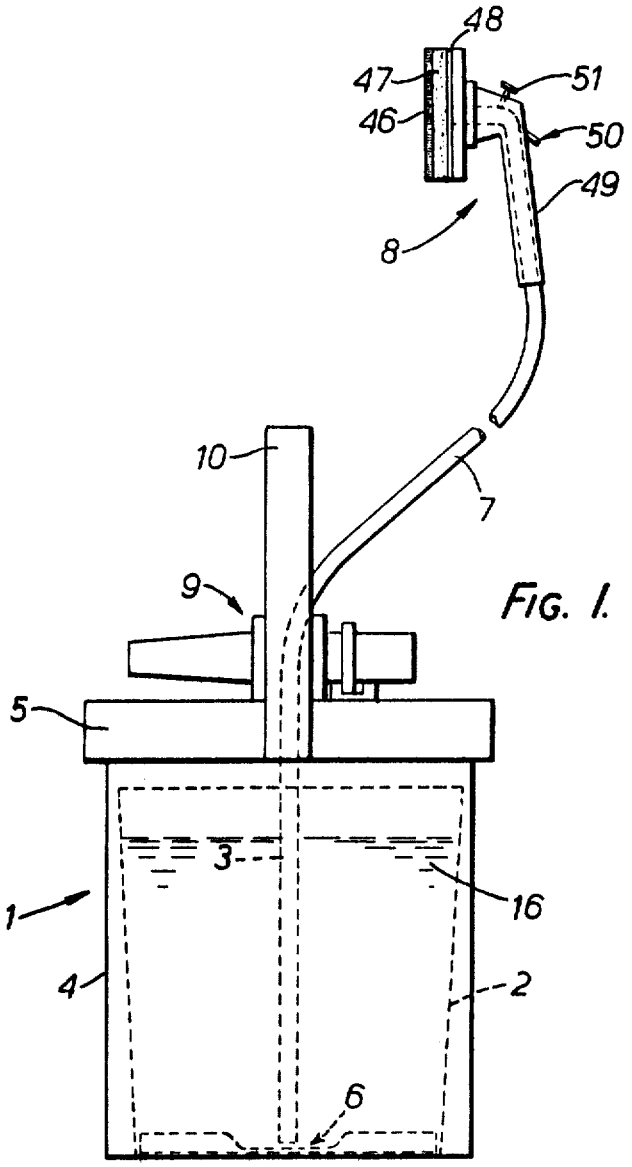
FIG. 1 is a side view of the apparatus.

FIG. 1 shows a vessel 1 of circular cross-section having a body 4 and a lid 5 in which is received a container 2 containing paint 16. The vessel 1 and container 2 are made of a plastics material. A feed conduit for the paint is provided by a pipe 3 extending from the centre of the lid 5 of the vessel, towards the bottom of the container. The container 2 has a well 6 formed in its base and the pipe 3 extends into this well. A flexible tube 7 which is one and a quarter meters long is attached to the end of the pipe 3 and leads to a paint pad 8.

A pressurizing assembly 9 including a capsule of liquefied gas and a reduction valve (not shown in FIG. 1) is mounted eccentrically on the lid 5 and pressurizes the vessel 1 and the inside and outside of the container 2. Also mounted on the lid 5 is a safety valve (not shown in FIG. 1) and a handle 10 which has two upright limbs extending from the diametrically opposite parts of the periphery of the lid 5 and an integral cross-member connecting the tops of the upright limbs. Thus, the handle 10 is of inverted rectangular 'U' shape.

Figure 2:
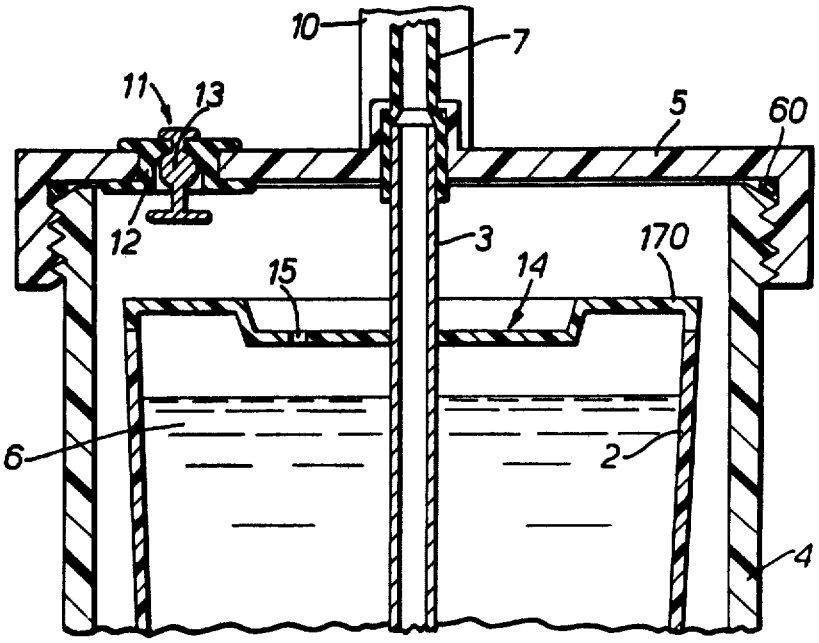
FIG. 2 is a sectional side view of part of the apparatus.

Referring now to FIG. 2, which shows the upper portion of the vessel 1 and the container 2 but does not show the pressurizing assembly 9, the lid 5 is screwed onto the body 4 of the vessel and an 'O' ring 60 seals the junction between these parts. The lid 5 has an aperture in which is received a safety valve 11 in the form of a pressure relief valve. The safety valve 11 comprises a grommet 12 and a valve member 13 received in the grommet 12. In its normal unoperated position shown in FIG. 2 the valve member seals the aperture in the lid 5.

Figure 2A:
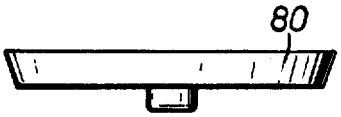
FIG. 2A is a side view of a closure member associated with a component shown in FIG. 2.

The top of the container 2 is defined by a lid 170 permanently fitted to the container 2 and defining a diaphragm 14 which has a central aperture through which the pipe 3 extends as a close fit and a small hole 15 which ensures equalisation of pressure between the inside and outside of the container but which is not sufficiently large to allow paint to pass through the hole except at a very slow rate. As can be seen in FIG. 2, the hole 15 is small relative to the central aperture through which the pipe 3 engages. The diaphragm 14 is inset from the top of the container defining a recess above the diaphragm which receives a sealing plug 80 (FIG. 2A) when the container 2 is not in use to seal the container. While the part 14 is referred to as a "diaphragm", it should be understood that this part may be of rigid construction.

The lid 5 has a central cylindrical recess within which the tube 7 is secured to the pipe 3. To assemble the apparatus the end of the tube 7 is passed through the lid 5 and fitted over the pipe 3. The tube 7 is then pulled back through the lid 5 drawing the end of the pipe 3 into the recess. The assembly of the pipe 3 and tube 7 are a tight fit in the recess and seal the junction of the tube 7 and the lid 5.

Figure 3:
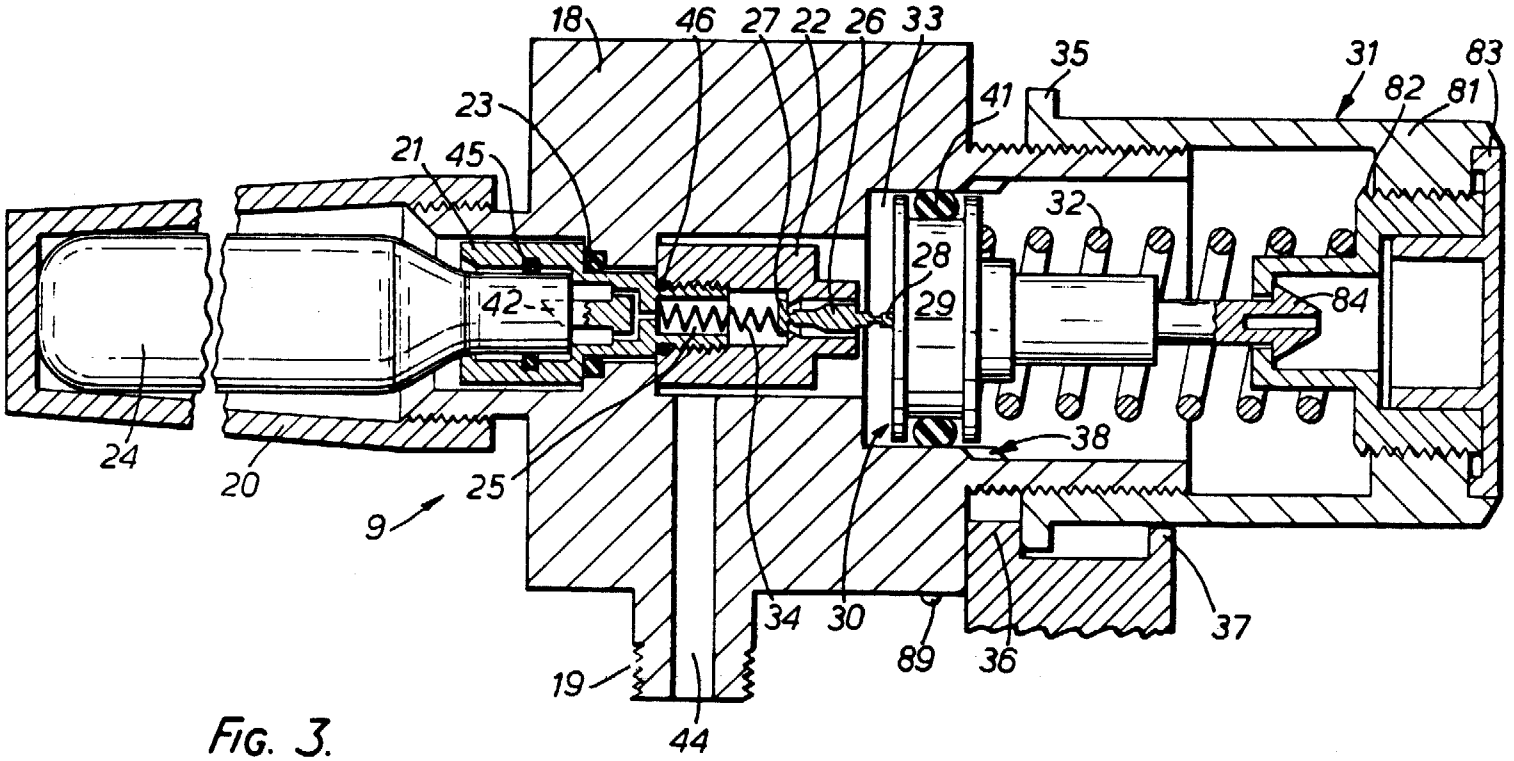
FIG. 3 is a sectional side view of another part of the apparatus.

Referring now to FIG. 3 which shows the pressurising assembly 9, the assembly has a body 18 including a screw threaded boss 19 which passes through an aperture in the lid 5 of the vessel 1 and to which a nut is secured to retain the assembly 9 on the lid 5. One or more pegs 89 on the base of the body 18 engage in corresponding recesses (not shown) in the top of the lid 5 and locate the assembly 9 on the lid 5. The assembly 9 includes a housing 20 for receiving a capsule 24 of liquid carbon dioxide. A capsule piercing member 21 including a piercer 42 is received in the body 18 and an 'O' ring 23 seals the interface of the piercing member 21 and the body 18. The end of the piercing member 21 adjacent the housing 20 has a bore sized to receive the neck of the capsule 24 and an 'O' ring 45 is seated in the bore to seal the interface of the capsule neck and the bore. To insert a capsule 24 into the assembly 9 the housing 20 is first unscrewed. The capsule 24 is then placed in the housing 20 and the housing 20 brought into position to be screwed onto the body 18. At this stage, the neck of the capsule 24 is in sealing engagement with the piercing member 21 but the capsule is to the left of the position shown in FIG. 3 so that the capsule is not yet pierced. As the housing 29 is now screwed onto the body 18, the housing drives the capsule onto the piercer 42 and the capsule is pierced allowing gas to flow along a fluid path from the capsule through the piercing member 21 into a chamber 25 defined by the piercing member 21 and a valve housing 22 which is screwed onto the piercing member and whose interface with the piercing member is sealed by an 'O' ring 46. The chamber 25 is the high pressure chamber of an adjustable pressure reducing valve assembly which will now be described.

The valve housing 22 slidably receives a valve member 26 which has a closure disc 27 at one end which is in the chamber 25 and a head 28 at the other end. The closure disc 27 abuts a seat formed on the housing 22 and is resiliently biased by a weak spring 34 against the seat. The right hand end (as seen in FIG. 3) of the body 18 has a bore 30 in which a piston 29 is slidingly received, an 'O' ring 41 being provided around the piston 29 to seal the interface of the piston 29 and the bore 30. The bore 30 is closed by a cap assembly 31 screwed onto the exterior of the body 18. The piston 29 is inwardly biased by a compression spring 32 extending between the piston and the cap assembly 31. In the position shown in FIG. 3 the head 28 of the valve member 26 abuts the piston 29. A chamber 33 is defined between the valve housing 22 and the piston 29; this chamber communicates with a duct 44 which extends through the boss 19 of the body 18 and thus provides a fluid path between the vessel 1 and the chamber 33.

The cap assembly 31 consists of an operating member 81 screw-threaded on the body 18, an adjusting member 82 screwed into an axial passage of the member 81 so that the relative axial position of the members 81 and 82 can be adjusted by screwing the member 82 into the chamber 81, and a closure member 83 which fits over the outer end of the axial passage in the member 81 and which conceals the adjusting member 82 and also locks the adjusting member 82 to the operating member 81. The spring 32 extends between the piston 29 and the adjusting member 82, and the maximum separation of the piston 29 and the adjusting member 82 is limited by the engagement of an anchor 84 extending from the piston 29 with the adjusting member 82.

Before insertion of the capsule 24, with the pressure in the vessel 1 atmospheric and with the valve set to provide a finite gauge pressure in the vessel 1, the pressure in chamber 33 is atmospheric so that the piston abuts the end face of the bore 30 and the valve member 26 is pressed against the action of the spring 34 to an open position in which the closure disc 27 is spaced from the seat on the valve housing 22. Upon insertion of the capsule 24, pressurized gas passes through the chamber 25 and the chamber 33 into the vessel 1. As the pressure in the chamber 33 then increases to above atmospheric the piston 29 is pressed outwards against the bias of the spring 32 to a position in which the force of the pressure over the face of the piston substantially equals the force of the spring 32 (there is also a force applied to the piston by the spring 34 but this is so small as to be insignificant). The pressure continues to increase until the piston reaches the position shown in FIG. 3 at which stage the closure disc 27 abuts the valve seat of the valve housing 22 and the flow of gas from the capsule stops.

When the pressure in the vessel 1 drops, for example as a result of paint being fed from the container 2, the force exerted by the spring 32 on the piston 29 will overcome the force of the gas pressure and the valve member 26 will be pressed into the open position. Thus the piston 29 and spring 32 regulate the pressure in the vessel 1. During normal operation the operating member 81 is in the position shown in FIG. 3. The pressure which this produces in the vessel 1 is dependant upon the axial position of the adjusting member 82 and this position is set in the factory to produce the desired pressure and the closure member 83 then positioned over the end of the adjusting member. For example, screwing the adjusting member 82 towards the piston 29 increases the compression of the spring 32 and therefore increases the pressure at which the valve member 26 is moved into the closed position. In order to set the position to which a user screws the operating member 81, a flange 35 is provided around the periphery of the member 81 and this flange engages a projection 36 on the lid 5 of the vessel 1 when the member 81 is screwed to the pressurized position.

Another projection 37 is provided on the lid 5 and engagement of the flange 35 with this projection 37 limits the outward movement of the member 81 and prevents the cap assembly being removed after the pressurizing assembly 9 is mounted on the lid 5.

In the event of the valve member 26 becoming stuck in the open position, the pressure on the piston 29 gradually increases and the piston is moved outwards against the bias of the spring 32. The bore 30 however is grooved at 38 so that once the piston reaches the ends of the grooves compressed gas can pass around the side of the piston and out to atmosphere through another groove provided along the screw threads of the member 81 and the body 18. As an alternative to providing the groove, the member 81 may be apertured.

When the operating member 81 is unscrewed so that the flange 35 abuts the projection 37, the head 84 extending from the piston 29 is compelled, by engagement with the adjusting member 82, to move outwardly. Thus even if the piston is inclined to stick, once the member 81 is unscrewed, the piston 29 will be in its outward venting position.

In the event of both the valve member 26 and the piston 29 becoming stuck there is still the safety valve member 13 in the top of the vessel 1 to stop excess pressure developing. Still another safety arrangement (not shown) may be provided by deliberately weakening a portion of the vessel 1 so that this portion of the vessel bursts in a controlled manner when the pressure exceeds a predetermined level; alternatively the vessel body 4 may be formed such that upon excess pressure developing, it distorts destroying the seal between the vessel body 4 and the lid 5.

Referring again to FIG. 1, the paint pad 8 is in some respects similar to a conventional pad in that it has an outer layer of material 46 supported on a foam backing layer 47 which has a closed cell structure so that it does not absorb the paint; the foam backing layer is in turn attached to a metal backing plate 48. Unlike conventional paint pads, however, the metal backing plate has a central aperture at which the flexible tube 7 terminates and the foam backing layer 47 contains a series of passages extending outwardly from the central aperture and terminating within the layer 46 at a plurality of locations distributed over the pad.

The flexible tube 7 passes through the handle 49 of the paint pad 8 and an on/off switch or valve 50 and a regulating screw 51 are provided on the handle 49.

Figure 4:
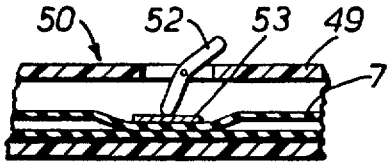
FIG. 4 is a sectional side view of a switch included in its apparatus.

The on/off switch 50 is shown in FIG. 4 and comprises a switch member 52 pivotally mounted intermediate its ends on the handle 49. One end of the switch member 52 presses via a small plate 53 on the tube 7 and the other end is used to operate the switch. In the position shown in FIG. 4 the switch is in the "off" position and the tub 7 is squeezed flat. If a user now pivots the switch member 52 anticlockwise (as seen in FIG. 4), the member 52 passes through a dead centre position and then allows the tube 7 to return through its own resilience to a circular cross-section. The plate 53 reduces the frictional force opposing movement of the tube 7 and reduces wear on the tube.

The rate of flow of paint through the tube 7 can be controlled by the regulating screw 51. Screwing in the screw 51 restricts the internal cross-sectional area of the tube 7 by flattening the tube. In the innermost position of the screw 51 the tube may be completely closed.

The operation of the apparatus shown in FIGS. 1 to 4 will now be described.

Paint is supplied to a user in the container 2 with the plug 80 sealing over the diaphragm 14. The user removes the plug 80 and places the container 2 in the vessel 1 and screws the lid 5 onto the vessel 1 at the same time inserting the pipe 3 which is secured to the lid 5 into the central aperture in the diaphragm 14. The user then ensures that the switch 50 on the paint pad is in the "off" position and inserts a capsule 24 into the assembly 9 as already described. The vessel 1 may be carried in the hand by the handle 10 but preferably the handle 10 is suspended from a belt passed around the waist of the user since this is less tiring and also leaves the user with a free hand. The handle 10 may be provided with a clip (not shown) for attaching the vessel 1 to a belt. The vessel 1 is pressurized by screwing in the cap assembly 31.

The user adjusts the rate of flow of paint with the regulating screw or regulator 51 and is then able to paint without interruption. The switch 50 enables the user to start and stop painting at will.

In the particular example described the container 2 has a capacity of one liter which is sufficient to paint about the twelve square meters of a surface and the capsule holds four liters of gas (at atmospheric pressure). The pressure in the vessel 1 is normally regulated to be in the range of between ten and twenty pounds per square inch above atmosphere while the pressure in the capsule is of the order of 700 to 900 pounds per square inch. One capsule contains more than sufficient gas to discharge all the paint from a container.

In order to recharge the vessel 1 with a new paint container the cap assembly 31 is unscrewed to the limit of its movement; this causes the valve member 26 to close (if it is not already closed) and compressed gas in the vessel 1 moves the piston 29 outwards and escapes to atmosphere around the edge of the piston. Even if the piston 29 tends to stick it is positively pulled outwards by engagement of the head 84 with the adjusting member 82. The lid 5 can then be unscrewed, since the vessel 1 must be at ambient pressure, the pipe 3 withdrawn from the container 2, the container removed from the vessel 1, and a new container inserted as described above. As the pipe 3 is withdrawn through the diaphragm 14, paint on the outside of the pipe is wiped off the pipe.

Figure 9:
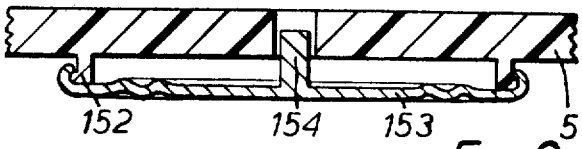
FIG. 9 is a sectional side view of a pressure indicator which may be incorporated in the apparatus.

It is helpful for the user to have some indication that the vessel 1 is pressurized and for this purpose a pressure indicator as shown in FIG. 9 may be provided. The indicator is mounted on the vessel lid 5 which is formed with an inwardly extending circular rib 152 over which a flexible diaphragm 153 is fitted. The upper face of the diaphragm 153 carries a projection 154 which is accommodated in a hole in the lid 5. When the vessel is not pressurized the diaphragm 153 is not flexed and the top of the projection 154 is below the upper surface of the lid 5. Upon pressurisation of the vessel, however, the diaphragm 153 flexes and the projection 154 protrudes from the lid 5; the projection 154 is preferably in a colour contrasting with the lid 5 so that it can be easily seen.

After use the apparatus is cleaned. Only the pipe 3, tube 7 and paint pad 8, however, require to be cleaned since the other parts of the apparatus do not come into contact with the paint. Even if the vessel 1 is inadvertently knocked over during use, the diaphragm 14 retains the paint in the container 2 so that the vessel 1 does not need cleaning. Since both the switch 50 and regulator 51 act externally on the tube 7 they do not become contaminated with paint. The paint pad 8 is dismantleable to facilitate cleaning.

The 'O' ring seals are made of a material which is not affected by the fluid to which they are exposed in use.

Conveniently the vessel 1, the flexible tube 7, the assembly 9, the handle 10, and the paint pad 8 are made of plastics materials. For water based paint the container 2 is preferably made of a plastics material but, since plastics materials are attacked by solvent based paints (for example gloss paints) over an extended period of time, the container 2 is preferably made of metal if it is to contain solvent based paints. The container 2 may be made in various other forms. For example the container may be made of cardboard with a metal foil liner.

It may be desirable to provide means to prevent the insertion in the vessel of an unsuitable container, that is one containing a paint of inferior grade of a grade different to the paint which the apparatus is primarily intended to feed. Such means may, for example, take the form of one or more interengaging ribs and grooves or other formations on the external surface of the container and the inner surface of the vessel, or of suitably shaping the interior contour of the vessel to inhibit the insertion therein of a container which has other than a matching shape.

If desired a multiplicity of balls may be provided on the surface of the paint 16, the balls each being of a diameter slightly bigger than the internal diameter of the pipe 3 and having a density very slightly lower than that of the paint so that they float with nearly all of the ball below the paint surface. A sufficient number of balls are provided such that there are two layers of balls across the entire surface of the paint. As the level of paint in the container 2 drops to a low level the lower layer of balls approach the bottom of the pipe 3; finally when the paint level is almost down to the level of the bottom of the pipe 3 the lower layer of balls reach the level of the bottom of the pipe 3 and one of the balls becomes located over the end of the pipe 3 preventing further flow of liquid. This automatic interruption of the paint flow when the container 2 is almost empty ensures that gas does not enter the pipe 3; if gas were allowed to enter the pipe 3 this could result in sputtering of the paint from the pad 8.

Figure 5:
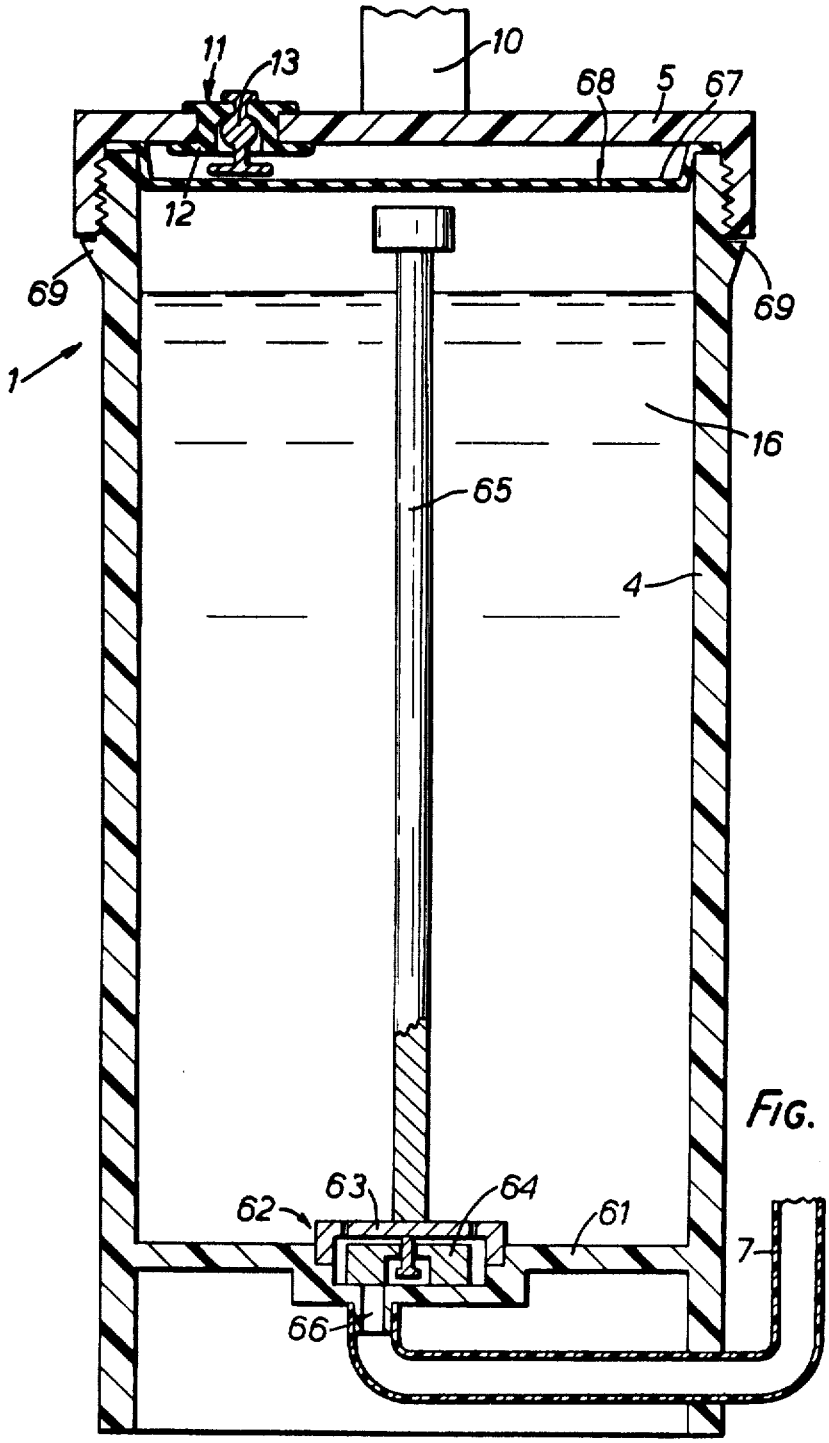
FIG. 5 is a sectional side view illustrating a modified form of the part of the apparatus shown in FIG. 2.

FIG. 5 shows a modified form of vessel in which the flexible tube 7 connected to the paint pad 8 is connected at the bottom of the vessel 1 rather than the top and the paint 16 is contained in the vessel itself rather than an inner container. In FIG. 5 parts corresponding to those illustrated in FIG. 1 or 2 are designated by the same reference numerals even though they may not be identical to those parts.

The vessel shown in FIG. 5 is elongate having a height which is almost twice its diameter. The vessel body 4 has a transverse bottom wall 61 which has a central cylindrical recess 62 in which an assembly comprising a filter 63, a float valve member 64 and a rod 65 is removably seated. At one side of the recess 62 a passage 66 is provided terminating in an outlet to which the tube 7 is attached. The tube 7 passes under the wall 61 and through an aperture in the vessel body 4.

The filter 63 is fixed to the rod 65 while the float valve member 64 is slidably mounted on the rod 65. During normal use the valve member 64 which is of a lower density than the paint remains clear of the opening to the passage 66 but when the vessel is almost empty the member 64 drops into a position covering and closing off the passage 66. This dropped position is the position shown in FIG. 5.

A partition in the form of a diaphragm 67 is removably fitted on the rim of the vessel body 4 and is sandwiched between the rim and the lid 5 sealing the junction of these parts. The diaphragm 67 has a slit 68 which enables gas from the pressurizing assembly 9 (not shown in FIG. 5) to pass through the diaphragm and pressurize the paint 16.

A number of projections 69 are provided around the periphery of the vessel body 4. The projections are located immediately below the lid 5 when the lid 5 is screwed fully onto the body 4 with the diaphragm 67 in place. If the diaphragm 67 is not in place the projections 69 prevent the lid being fully tightened, the vessel is not sealed and the apparatus cannot be used. Thus inadvertent use of the vessel without the diaphragm in place is not possible.

In order to fill the vessel shown in FIG. 5 with paint, the lid 5 is unscrewed and the diaphragm 67 removed. Paint is then poured into the vessel 1, ensuring that the rod 65, filter 63 and member 64 are in place, the diaphragm is pressed over the rim of the vessel body 4 and the lid 5 screwed on. The vessel is then pressurized in the same manner as described with reference to FIGS. 1 to 4 and the apparatus is used also in the same manner as described with reference to FIGS. 1 to 4. The filter 63 is provided to prevent clogging of the tube 7 or the paint pad 8 from any foreign bodies or pieces of paint skin that may be in the paint. Such a filter is not necessary in the apparatus shown in FIGS. 1 and 2 since the paint in the container 1 has not been exposed since being bottled by the manufacturer. It will be understood that the float member 64 serves the same function as the balls, if they are provided, in the apparatus of FIG. 2 and prevents sputtering of paint when the container is nearly empty.

After painting, the lid 5 and diaphragm 67 are removed and any paint left poured back into its original container, the rod 65 being held by the user at the top to prevent it falling out. Provided the vessel has not been tipped over the top of the rod 65 should be free of paint.

The rod 65, filter 63 and member 64 can be lifted out of the vessel 1 to facilitate cleaning.

Figure 6:
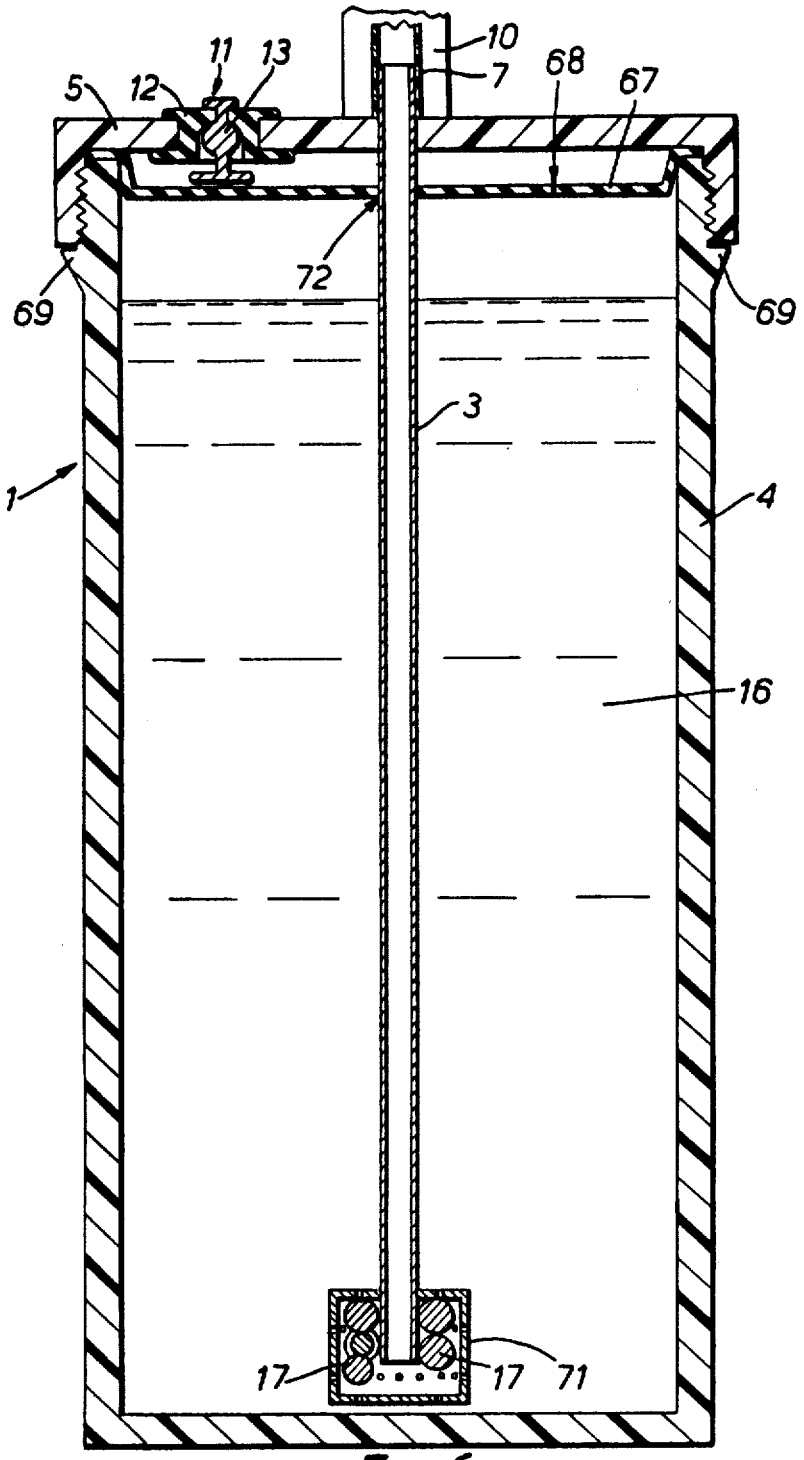
FIG. 6 is a sectional side view illustrating another modified form of the part of the apparatus shown in FIG. 2.

FIG. 6 shows another modified form of vessel in which the paint 16 is contained in the vessel itself as in FIG. 5 but the flexible tube 7 is connected at the top of the vessel as in FIGS. 1 and 2. In FIG. 6, parts corresponding to those illustrated in FIG. 1, 2 or 5 are designated by the same reference numerals even though they may not be identical to those parts.

A filter 71 of closed cylindrical shape is press fitted to the base of the tube 3. Inside the filter 71 are a plurality of balls 17 which serve the same function as the balls, if they are provided, in the apparatus of FIG. 2.

The diaphragm 67 is the same as that shown in FIG. 5 except that it has a central aperture 72 through which the pipe 3 passes as a close fit.

In order to fill the vessel shown in FIG. 6 with paint, the lid 5 is first unscrewed and removed. Removing the lid 5 also removes the pipe 3 and filter 71 and since the diaphragm 67 is a close fit around the pipe 3, the diaphragm is also removed. The vessel 1 is then filled with paint and the lid 5, pipe 3, filter 71 and diaphragm 67 replaced. The vessel is then pressurized and the apparatus used in the same manner as described with reference to FIGS. 1 to 4. The filter 71 and the diaphragm 67 can be removed from the pipe 3 to facilitate cleaning.

In the drawings the pressure vessel 1 is shown with square corners and straight sides. In accordance with well known design procedure for such vessels, however, the corners are preferably rounded off and the sides bowed outwardly.

After use of any of the forms of apparatus described above, the apparatus may be cleaned by pumping a solvent, which in the case of water based paints may be water, through the apparatus using the pressure of the capsule of carbon dioxide.

When using the vessel shown in FIG. 6 a user may if he prefers place a small open tin of paint in the vessel 1 instead of pouring the paint into the vessel. This avoids cleaning of the vessel 1 after use.

In the illustrated apparatus a paint pad is attached to the free end of the tube 7. However, a paint brush or roller may alternatively be attached, these devices having an on/off switch and a regulator similar to the paint pad. When using a brush, the flow of paint may be required to be somewhat slower and this can be achieved by appropriate adjustment of the regulator on the brush handle. If desired the applicator may be of a modulator construction consisting of a handle incorporating the on/off switch and the regulator and a plurality of heads including at least one pad, roller and brush which can be attached to the handle. The on/off switch and the regulator may be combined into a single control if desired. For the sake of simplicity the regulator may be omitted.

A shoulder strap may be attached to the vessel 1 to allow a user to carry the vessel over his shoulder or any other arrangement may be provided to enable a user to carry the vessel.

The lid 5 may be clamped onto the body 4 of the vessel 1 by a plurality of toggle clamps, instead of screwing the lid onto the body. This has the advantage that the 'O' ring or diaphragm is not subjected to a rubbing action upon tightening of the lid 5. Furthermore, the toggle clamps can be spring biased into their closed position in such a way that if the pressure in the vessel exceeds a predetermined level at least one of the toggle clamps is forced open and the lid 5 lifts off the vessel body 4.

Figure 7:
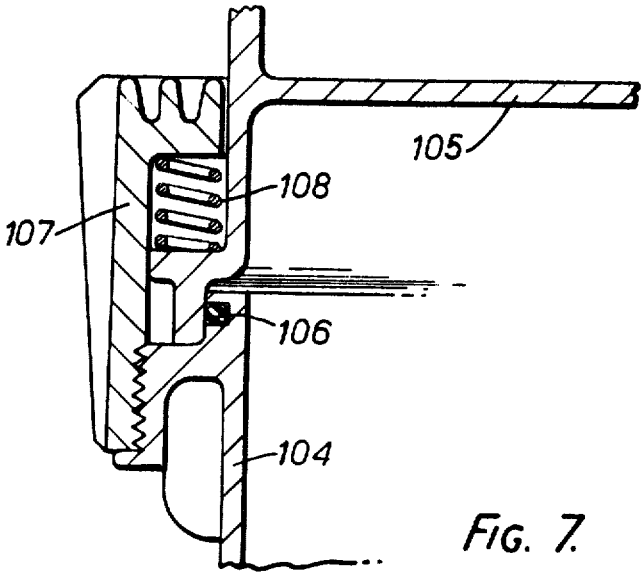
FIG. 7 is a sectional side view of a small part of the apparatus illustrating a modification which may be made to the apparatus of FIG. 2.

A particular example of a lifting lid assembly is shown in FIG. 7. In this figure, the vessel body 104 is shown with a lifting lid 105, an O ring seal 106 being provided between portions of the walls 104 and 105 which with the vessel 1 overlapping are unpressurized. The lid 105 is retained on the body 104 by a ring clamp 107 screwed onto the body 104 and a number of springs 108 are provided around the periphery of the lid 105 between the lid 105 and the ring clamp 107. In the position shown in FIG. 7, the vessel is unpressurized, the lid 105 rests on top of the body 104 and the springs 108 are substantially unstressed.

As the vessel 1 is pressurized the lid 105 lifts off the body 104 and the springs 108 become stressed. Under normal operating pressure portions of the walls 104 and 105 continue to overlap and the 'O' ring 106 seals the interface therebetween. Upon excess pressure developing, however, the springs 108 are further compressed and the lid 105 is lifted clear of the 'O' ring 106 venting the vessel.

In the arrangement shown in FIG. 2 the diaphragm 14 has a hole 15 which ensures equalisation of pressure between the opposite sides of the diaphragm. In place of the aperture, a slit may be provided in the diaphragm, extending for example radially from the central aperture in the diaphragm.

Alternatively it may be possible to omit both the pin hole and the slit and rely on the diaphragm flexing in the region of its central aperture to allow the passage of gas between the diaphragm 14 and the pipe 3. Similarly although the diaphragm in FIG. 5 is shown having a slit, this may be replaced by a pin hole aperture and the diaphragm in FIG. 6 may have a pin hole aperture instead of a slit or alternatively it may be possible to omit both the pin hole aperture and the slit.

The diaphragm 14 may, if desired, initially be without the central aperture. In this case the pipe 3 is provided with a pointed end and is sufficiently stiff to puncture the diaphragm when it is first pressed through the diaphragm. It may be advantageous to neck the pipe where it engages the diaphragm. This may be advantageous if an anti-sputter arrangement of a kind which will now be described is employed in the apparatus shown in FIG. 2. The anti-sputter arrangement consists of providing a compression spring under the container 2 so that as the container 2 empties of paint it becomes lighter and is lifted up relative to the vessel 1, and, when the container 2 is virtually empty of paint, the end of the pipe 3 bears against the bottom of the container 2 sealing over the pipe 3. If desired a resilient member for example a closed cell foam may be provided on the bottom of the container 2 under the pipe 3 to ensure that a good seal is obtained between the pipe and the container.

Necking the pipe 3 where it passes through the diaphragm ensures that there is very little resistance to relative motion of the container 2 and the pipe 3 and also allows free flow of gas into the container. When the pipe 3 is withdrawn from the container 2 after use the lower unnecked portion of the pipe is wiped clean as it passes through the diaphragm.

In the pressure reducing valve assembly shown in FIG. 3 a piston 29 is used. As an alternative a diaphragm connected to the wall of the bore 30 and spring biased in the same manner as the piston 29 could be used. In this case it may not be possible for gas pressure to be vented through the cap 31. An alternative way of venting the gas may be to open the safety valve. The spring 34 which biases the valve member 26 into its closed position may be omitted since gas pressure from the capsule 24 can be used to perform this biasing function.

The housing 20 of the pressure reducing valve assembly 9 may be provided with external radially projecting fins to facilitate screwing and unscrewing of the housing 20. Also the capsule 24 may be located in the housing 20 in such a way that when the housing is unscrewed the capsule 24 is automatically withdrawn from the piercer 42 and comes away with the housing from which it is then removed.

Figure 8:
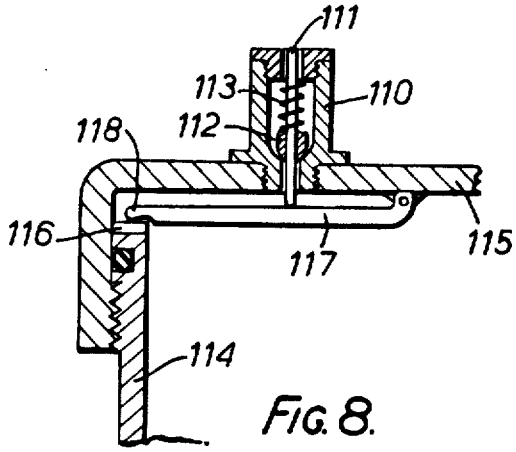
FIG. 8 is a sectional side view of another small part of the apparatus illustrating another modification which may be made to the apparatus of FIG. 2.

The safety valve assembly may be modified in such a way that every time the lid 5 is secured to the vessel body 4 the safety valve is tested. An arrangement of this kind is shown in FIG. 8. In this arrangement the safety valve assembly consists of a housing 110 in which a valve member 111 carrying a closure member 112 is mounted. A spring 113 biases the closure member 112 onto a spherical seat formed at the bottom of the housing 110. Upon excess pressure developing the closure member 112 is lifted off its seat venting the vessel. The interface of the vessel body 114 and screw-on lid 115 is around the outside of the body and is sealed by an 'O' ring. On one portion of the top of the vessel body 114 a ramp shaped cam surface 116 is provided. A lever 117 is pivotally mounted on the lid 115 at one end and has a cam follower 118 on the other engaging the top of the vessel body 114. Intermediate the ends of the lever 117, the lever touches or is spaced just underneath the lower end of the valve member 111. As the lid 115 is screwed onto the body 114, the lever 117 engages the cam surface 116 once in each revolution of the lid and this engagement raises the lever 117 lifting the valve member 111 into its vented position. When the lid is fully screwed on, the cam surface 116 is arranged to be spaced circumferentially from the cam follower 118 so that the safety valve assembly is closed.

Although the apparatus has been described with reference to the application of paint, it can be used to apply other liquids to a surface. For example it can be used to apply preservative to a wooden surface or for washing surfaces. The apparatus can also be used to feed liquids to other kinds of applicators, for example to a spray head. With a spray head, the apparatus can be used as a garden spray apparatus.

We claim:

1. A portable apparatus for feeding paint under pressure to an applicator, comprising:

an outer vessel;

a paint container received, in use, within the interior of the vessel with part of the interior of the vessel remaining for occupancy by gas;

said container having a lid fitted thereto and extending over the top thereof;

a pressurizing assembly supported by the vessel, and including a housing having a capsule of pressurized gas therein and further having pressure reducing means therein, the pressure reducing means having a high pressure side and a low pressure side;

a first fluid path extending from the high pressure side of the pressure reducing means and communicating with the outlet of the pressurized gas capsule;

a second fluid path extending from the low pressure side of the pressure reducing means through the vessel and into the container whereby the interior of the container can be pressurized;

a feed conduit connected, in use, to the applicator, said feed conduit extending into the vessel from the exterior thereof and extending into the interior of said container for transferring paint therefrom to the applicator;

said lid having a hole therein and said feed conduit extending through said hole and being removable and insertable therethrough as a close fit therein; and restricted transfer means, associated with the paint container and communicating with said part of the interior of the vessel and the interior of the paint container, for allowing flow of gas between said part of the interior of the vessel and the interior of the paint container to equalise the pressures therein, but for preventing passage of paint therethrough, except at a very slow rate, from said container into said part of the interior of the vessel;

the combination of the paint container having said lid, said feed conduit having said close fit with respect to said hole in said lid, and the functioning of said restricted transfer means substantially preventing paint from contaminating the interior of said outer vessel, even if during use the vessel is inadvertently knocked over.

2. An apparatus according to claim 1, in which the feed conduit passes through the top of the vessel to a location adjacent the bottom of the container.

3. An apparatus according to claim 2, in which said restricted transfer means is an aperture provided in said lid, said aperture being small relative to said hole.

4. An apparatus according to claim 3, in which the container includes a removable closure member, and said lid has a central recess therein, said hole and said aperture being in said central recess, and said closure member being inserted in and sealing said central recess when said paint container is not in use.

5. An apparatus according to claim 1, in which the pressure reducing means includes a valve member mounted in a passage providing communication between the first fluid path and the second fluid path, the valve member being movable between a first position in which the passage is closed and a second position in which the passage is open, the valve member being resiliently biased, in use, into the first position, and a movable member cooperable with the valve member and movable away from one position in which the valve member is held in the second position by the movable member to another position in which the valve member assumes its first position, the movable member being biased to said one position by a spring and being biased away from said one position to another position by the pressure of gas on the low pressure side of the pressure reducing means.

6. An apparatus according to claim 5, in which the bias force of the spring acting on the movable member is adjustable, whereby the pressure of gas required to move the movable member away from said one position to another position is adjustable.

7. The apparatus according to claim 1, in which the movable member is a piston.

8. An apparatus according to claim 1, in which the outer vessel comprises a body part and a lid.

9. An apparatus according to claim 8, in which the pressurizing assembly is mounted on the lid of said vessel and includes manually operable means for venting the pressurized gas in the vessel to return the pressure in the vessel to atmospheric pressure.

10. An apparatus according to claim 8, in which a pressure relief valve is mounted in the lid of the vessel.

11. An apparatus according to claim 10, wherein the lid of the vessel is screwed onto the body part of the vessel; and further including a cam formed on the body part of the vessel and a cam follower associated with the vessel lid and the pressure relief valve, whereby the cam actuates the pressure relief valve via the cam follower each time the vessel lid is screwed onto the body of the vessel.

12. An apparatus according to claim 1, in which a handle is mounted on the vessel.

13. An apparatus according to claim 1, in which the bottom of the paint container has a well formed therein, and wherein an end of the feed conduit is within the well.

14. An apparatus according to claim 1, further including one or more interengaging formations on the external surface of the container and the internal surface of the vessel for inhibiting the insertion in the vessel of an unsuited container.

15. An apparatus according to claim 1, further including a hand-held applicator, in which the feed conduit includes a flexible tube extending between the vessel and the applicator.

16. An apparatus according to claim 15, in which the feed conduit comprises a relatively rigid pipe in the vessel and a flexible tube extending between the pipe and the applicator, one end of the tube being fitted over one end of the pipe and the junction of the tube and the pipe being a tight fit in an internal recess of the vessel, the tube passing through a bore extending between the recess and the exterior of the vessel.

17. The apparatus recited in claim 1, wherein said restricted transfer means comprises a pin hole in said lid.

18. The apparatus recited in claim 1, wherein said restricted transfer means comprises a slit in said lid.

19. A portable apparatus for feeding paint under pressure to an applicator, comprising:

a vessel having a body part and a removable lid;

a partition extending across the interior of the vessel below but adjacent said lid and defining a paint containing portion of the vessel beneath the partition and an upper gas containing portion of the vessel above the partition;

a pressurizing assembly supported on the vessel and including a housing for receiving a capsule of pressurized gas and further including pressure reducing means;

a first fluid path extending from the high pressure side of the pressure reducing means for communicating with the outlet of a capsule inserted, in use, in the housing;

a second fluid path extending from the low pressure side of the pressure reducing means through the lid of the vessel into said upper portion of the vessel;

a slit in the partition, said slit not being sufficiently large to allow paint to pass therethrough, except at a very slow rate, but allowing said gas under pressure to flow therethrough, whereby paint is substantially prevented from reaching the interior of said upper portion and said second fluid path; and a feed conduit communicating with said paint containing portion of the vessel and connected, in use, to the applicator for transferring paint from the vessel to the applicator.

20. An apparatus according to claim 19, in which a filter is provided adjacent the end of the feed conduit in the vessel to filter liquid passing into the end of the feed conduit.

21. An apparatus according to claim 19, in which the feed conduit extends through the partition and the lid of the vessel, the partition having a hole therein through which the feed conduit extends as a close fit.

22. An apparatus according to claim 19, in which the feed conduit passes out of the bottom of the vessel.

23. An apparatus for feeding paint under pressure to an applicator, comprising:

a vessel;

a pressurizing assembly connected to said vessel, said assembly having a housing adapted to receive a capsule of pressurized gas and having pressure reducing means;

a first fluid path extending from the high pressure side of said pressure reducing means and communicating with the outlet of the capsule inserted, in use, in said housing;

said vessel having defined internally therein a first chamber and a second chamber, said second chamber being adapted to contain the paint to be fed to the applicator;

a diaphragm extending across at least part of the interior of said vessel below the top thereof, and being disposed between and separating said first and second chambers;

a second fluid path extending from the low pressure side of said pressure reducing means into said first chamber for supplying gas thereto from said capsule;

said diaphragm having a pin hole therethrough for allowing gas to flow from said first chamber into said second chamber to equalize the pressure in said chambers, so pressurizing the interior of said second chamber, and for preventing flow of paint, except at a very slow rate, from said second chamber to said first chamber whereby the paint is substantially prevented from reaching said second fluid path and the interior of said first chamber; and a feed conduit connected to said vessel and communicating with said second chamber, and connected, in use, to the applicator for transferring paint from said second chamber to the applicator.

24. The apparatus recited in claim 23, wherein said vessel has a body part and a removable lid, and the periphery of said diaphragm is sealed between the lid and said body part.

25. The apparatus recited in claim 23, wherein said second chamber is defined by a paint container received within said vessel, and said diaphragm is formed by the top of said container.

26. The apparatus recited in claim 23, further comprising a pressure relief valve mounted on said vessel and communicating with said first chamber for venting said first chamber to atmosphere when excess pressure develops therein.

27. The apparatus recited in claim 23, wherein said second chamber is a paint container replaceably disposed in said vessel, said diaphragm forming the top of said container and having a central recess therein adapted to be sealed, when not in use, by a removable plug, said recess having a central aperture therein for sealingly engaging said feed conduit inserted in use therethrough, and said pin hole is located in said recess and spaced from said aperture.

28. An apparatus for feeding liquid under pressure to an applicator, comprising:

a vessel having a body part and a lid removably secured thereto;

a pressurizing assembly supported by said vessel, said assembly having a housing for receiving a capsule of pressurized gas and further having pressure reducing means provided with a high pressure side and a low pressure side;

a first fluid path extending from the high pressure side of said pressure reducing means and communicating with the outlet of the capsule inserted, in use, in said housing;

said vessel having defined therein a first chamber and a second chamber, said second chamber being adapted to contain the liquid to be fed to the applicator;

a diaphragm disposed below said lid and extending transversely across said body part to separate said first and second chambers with said first chamber between said diaphragm and said lid and said second chamber below said diaphragm;

said diaphragm and said lid being sealed together around the periphery of said diaphragm by the securing of said lid to said body part, and said diaphragm having a central hole therein;

a second fluid path extending from the low pressure side of said pressure reducing means and communicating with said first chamber for supplying gas thereto from said capsule;

a feed conduit communicating with said second chamber and extending externally of said vessel, and being connected, in use, to the applicator for transferring the liquid from said second chamber to the applicator;

said feed conduit extending through said hole and being removable and insertable therethrough as a close fit therein; and means, associated with said diaphragm internally of said periphery thereof, for allowing said gas to flow through said diaphragm but preventing the passage of said liquid therethrough, except possibly at a very slow rate;

whereby the pressure in said chambers is equalised and liquid is substantially prevented from reaching the interior of said first chamber.

29. The apparatus recited in claim 28, further comprising means, located in said lid, for indicating when said first chamber is pressurized.

30. The apparatus recited in claim 28, wherein said feed conduit comprises a tube extending upwardly from said second chamber, through said diaphragm, and through said lid in sealing relationship therewith.

31. An apparatus for feeding paint to an applicator, comprising:

a portable vessel having a body part and a lid removably secured thereto;

means for supplying gas under pressure to the interior of said vessel;

said vessel having defined therein a first chamber and a second chamber, said second chamber being adapted to contain the paint to be fed to the applicator, and said first chamber being adapted to contain said gas under pressure;

a feed conduit communicating with said second chamber and extending externally of said vessel for connection to the applicator for transferring paint from said second chamber to the applicator under the pressure of said gas;

a diaphragm disposed below said lid and separating said first and second chambers, and said diaphragm having a hole therein through which said feed conduit extends as a close fit; and said diaphragm having an aperture therein for allowing said gas under pressure to flow through said diaphragm to equalise the pressure in said chambers, said aperture being small relative to said hole and not being sufficiently large to allow the paint to pass therethrough, except at a very slow rate, whereby if the vessel is inadvertently knocked over during use the diaphragm substantially retains the paint in said second chamber.

32. The apparatus recited in claim 31, wherein said diaphragm and said lid are sealed together around the periphery of said diaphragm by the securing of said lid to said body part, and said gas supplying means comprises a pressurizing assembly supported by said vessel, said assembly having a housing for receiving a capsule of pressurized gas and further having pressure reducing means provided with a high pressure side connected to said housing and a low pressure side connected to said first chamber.

33. The apparatus recited in claim 32, wherein said body part has projections provided around the periphery thereof, said projections being located immediately below said lid when said lid is fully secured to said body part with said diaphragm present, but in the absence of said diaphragm said projections being contacted by said lid when said lid is secured to said body part and preventing the lid sealing against said body part so rendering to apparatus inoperable.

34. An apparatus for feeding a liquid to an applicator, comprising:

a portable outer vessel;

means for supplying gas under pressure to the interior of said vessel;

a liquid container replaceably disposed in said vessel and leaving part of the interior of said vessel for occupancy by said gas under pressure, the top of the liquid container comprising a diaphragm;

a feed conduit connected to the applicator and extending into said vessel and into said liquid container for transferring liquid from said liquid container to the applicator under the pressure of said gas;

said diaphragm having a central recess therein, said central recess having a central hole therein engaging as a close fit around said feed conduit inserted in use therethrough, and said recess having an aperture therein which is small relative to said central hole, said aperture not being sufficiently large to allow the liquid to pass therethrough, except at a very slow rate, but allowing said gas under pressure to flow therethrough; and a plug removably inserted in and sealing said recess when said liquid container is not in use.

35. The apparatus recited in claim 34, wherein said aperture is a pin hole.

36. The apparatus recited in claim 34, wherein said aperture is a slit.

* * * * *